United States Patent [19]

Stalder et al.

[11] Patent Number: 4,565,063

[45] Date of Patent: Jan. 21, 1986

[54] METHOD AND APPARATUS FOR FALSE TWIST SPINNING

[75] Inventors: Herbert Stalder, Kollbrun; Emil Briner, Winterthur, both of Switzerland

[73] Assignee: Rieter Machine Works Ltd., Winterthur, Switzerland

[21] Appl. No.: 624,224

[22] Filed: Jun. 25, 1984

[30] Foreign Application Priority Data

Jul. 1, 1983 [CH] Switzerland ..... 3633/83

[51] Int. Cl.[4] ..... D01H 5/28

[52] U.S. Cl. ..... 57/328; 57/5; 57/333

[58] Field of Search ..... 57/328, 333, 315, 5

[56] References Cited

U.S. PATENT DOCUMENTS

| | | | |
|---|---|---|---|
| 3,487,619 | 1/1970 | Field, Jr. | 57/328 |
| 4,003,194 | 1/1977 | Yamagata et al. | 57/328 |
| 4,387,487 | 6/1983 | Nakahara et al. | 57/328 X |
| 4,412,413 | 11/1983 | Sakai et al. | 57/328 X |

FOREIGN PATENT DOCUMENTS 615467 1/1980 Switzerland .

*Primary Examiner*—John Petrakes

*Attorney, Agent, or Firm*—Werner W. Kleeman

[57] ABSTRACT

A fiber sliver is drafted to a yarn count in a drafting mechanism and is fed to a false twist unit with a sliver width B1 of 10 to 19 mm. In accordance with the method, by means of the width B1, the fiber sliver leaving the delivery roller pair is divided into a yarn core rotated by the false twist member with a spinning triangle of the width B2 and into edge fibers delivered thereto. The edge fibers are taken up by the rotating yarn core in the suction passage of the false twist unit. The taking-up of the edge fibers occurs in that the front ends of the delivered edge fibers are caught by the rotating yarn core in the region of the narrowest portion of the suction passage and are wound about the yarn core with the same rotational direction as the fiber core but with a substantially larger inclination until the rear end of the edge fibers is wound into the yarn core in the spinning triangle. To maintain the width of the fiber sliver, as delivered by the apron pair and determined by the funnel, until catching of the sliver by the nip line of the delivery roller pair, one of the two aprons is extended into the converging space of the delivery roller pair and both aprons are guided so close to the corresponding roller of the delivery roller pair that the spacings between the aprons and the delivery rollers are close to zero. The spacing between the nip line and the narrowest portion of the suction passage is shorter than the average length of the procesed edge fibers, in order to ensure that the rear end of the edge fibers is not released from the nip line before the edge fibers are wound in the spinning triangle.

32 Claims, 18 Drawing Figures

PRIOR ART

METHOD AND APPARATUS FOR FALSE TWIST SPINNING

BACKGROUND OF THE INVENTION

The present invention relates to an improved method of false twist spinning entailing the method steps:

that a fiber sliver is drafted to a desired yarn count in a drafting mechanism and is delivered as drafted fiber sliver from a delivery roller pair of the drafting mechanism, that the drafted fiber sliver thereafter is sucked in substantially spiral fashion into a converging passage and is thereafter taken-up by a false twist member, and that by means of the false twist member a part of the drafted fiber sliver is twisted to a so-called false-twisted yarn core with the formation of a spinning triangle.

The present invention further relates to an improved apparatus for false twist spinning comprising a drafting mechanism for delivering a drafted fiber sliver to a suction passage and with a false twist member arranged after the suction passage, the suction passage converging to its narrowest location or throat in a direction towards the false twist member.

The problems associated with yarns produced by the false twist spinning method during further processing to finished fabrics lie substantially in the uniformity or evenness, strength and extensibility. For example, non-measurable, repeating weak places, even when the measured strength of the yarn is much higher, represent substantial disadvantages in warping and weaving processes, and nops reduce the value of the finished fabric even where the yarns produce no problems in the subsequent processing stages.

A method and an apparatus of the general character heretofore described are known from Swiss Pat. No. 615,467.

In this known process, and in this known apparatus, which is illustrated schematically and partly in section in accompanying FIG. 1, a fiber sliver 2 delivered to a drafting. mechanism 1 is standardized or calibrated by funnels 5 and 6 respectively provided before an infeed roller pair 3 and an intermediate roller pair 4, and is guided by an apron pair 8 extending from the intermediate roller pair 4 towards the delivery roller pair 7 (the roller pairs are indicated with broken lines).

In the converging space of the delivery roller pair 7 a further funnel 9 is provided for collecting the edge fibers F and to avoid as far as possible loss of these edge fibers.

In the method according to the prior art, the fiber sliver 2 is delivered from the apron pair 8 (of which only the lower apron is shown) with a width BA and is fed to the nip line K formed by the delivery roller pair 7.

In the converging space of the delivery roller pair 7, the fiber sliver undergoes spreading due to the peripheral air of the rotating delivery roller pair 7 transported into this space and escaping in the axial direction; this spreading is limited by the funnel 9 to a width BB.

Due to the difference between the width BB and the smaller width BC of the spinning triangle, the aforementioned edge fibers F occur which are drawn by suction into a suction passage 10 and at the latest at the narrowest location or throat of the suction passage, that is before the throttle position 11. For the most part these edge fibers are caught up by the rotating false-twisted yarn core 12. The twist in the yarn core 12 arises from the pneumatic false twist member 13 arranged downstream from the throttle position 11.

The essential disadvantage of this method lies in inadequate uniformity or evenness of the yarn in respect of weight-evenness, weak places and nops. Also, the strength of the yarn is substantially lower than that of the normal ring-spun yarns. This inadequate regularity is substantially due to the fact that the described fiber spreading occurs randomly and uncontrolled.

SUMMARY OF THE INVENTION

It is therefore an important object of this invention to produce a method and an apparatus with which a yarn can be produced which is more even in respect of the aforesaid characteristics.

This object and others which will become more readily apparent as the description proceeds are achieved by the inventive method in that, the drafted fiber sliver is delivered from the delivery rollers with a width such that only a part of the width of the drafted fiber sliver is caught or entrained by the spinning triangle, that is twisted to a false-twisted yarn core, and the so-called edge fibers, which are not caught or entrained by the spinning triangle, are taken up by suction in such manner and are so guided by means of the suction air stream that, as viewed in the direction of transport of the yarn core, the front end of a fiber with a length corresponding to the average length of the processed fibers is caught or entrained by the rotating yarn core when it is ensured that this fiber leaves the nip line of the delivery roller pair only after it has been twisted about the yarn core in the same direction as, but with a steeper angle of twist than, the yarn core for so long that it is caught or entrained in the spinning triangle and thus the rear end is bound into the yarn core.

The apparatus according to the invention is characterized by the features that the drafting mechanism is provided before its delivery roller pair delivering the fiber sliver to the suction passage with means which guide the fiber sliver in the drafting mechanism in such a manner that the drafted fiber sliver delivered by the delivery roller pair has a width which is greater than the width of the spinning triangle of the yarn core twisted by means of the false twist member, and that the spacing between the nip line or nip formed by the delivery roller pair and the narrowest location or throat of the suction passage is not larger than the average fiber length of the fibers in the fiber sliver. Additionally, the suction passage has a converging form such that free-front fiber ends (which are delivered by the delivery roller pair, are guided in the air stream and are not bound into the rotating yarn core produced by the false twist member), are guided by the air stream shortly before the narrowest location or throat of the suction passage in such a manner towards the rotating yarn core, and thereby are caught or entrained by the rotating yarn core, that the rear ends of the fibers are still nipped or clamped by the delivery roller pair.

Accordingly, the advantages produced by the invention lie in a yarn of high strength, which is more even and which possesses the above-mentioned characteristics or properties. These properties are mentioned in the descriptive portion in connection with the described exemplary embodiments.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
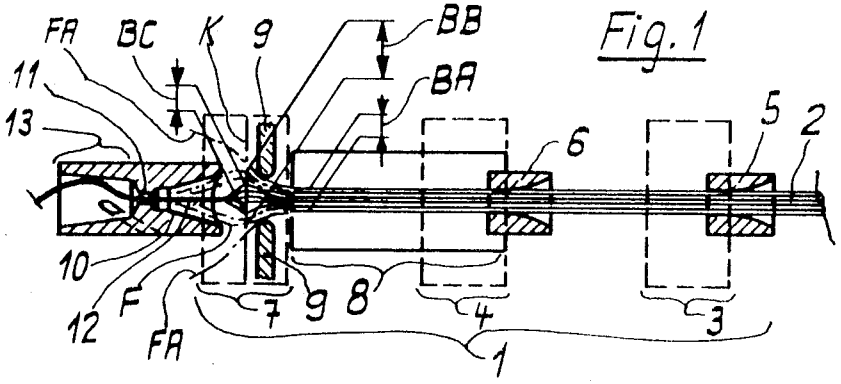
FIG. 1 illustrates a prior art construction of false twist spinning apparatus as described hereinbefore.

Describing now the drawings, in a drafting mechanism 101 (FIG. 2), a fiber sliver 102 is drafted to the count of a finished yarn in a break drafting field or pre-drafting zone between an infeed roller pair 103 and an intermediate roller pair 104 and in a main drafting field or zone between the intermediate roller pair 104 and a delivery roller pair 105. The thus drafted fiber sliver 102 is then twisted to a yarn 107 in a false twist spinning unit or device 106 (illustrated in section).

The drafting mechanism 101 further comprises a condenser 108 as a first fiber sliver guide element arranged before the infeed roller pair 103, a condenser 109 as a second fiber sliver guiding element arranged before the intermediate roller pair 104, and an apron pair 110 constituting a further fiber sliver guiding element arranged before the delivery roller pair 105. The apron pair 110 comprises an upper apron 111 and a lower apron 112. Guidance of the roller pairs and apron is known and does not constitute the subject of the invention.

The condenser 108 serves for the primary guidance of the fiber sliver 102 and the condenser 109 serves for secondary guidance thereof. The bore-section or inner width of these condensers 108 and 109 is such that between the apron pair 110 the fiber sliver 102 has a width B1 of 10 to 19 mm; for a yarn titer of approximately 15 tex, the width B1 is preferably from 14 to 15 mm. In order to maintain this width B1 substantially unchanged up to the nip line or nip K produced by the delivery rolls 105, as a first measure one of the two aprons 111 or 112 of the apron pair 110 is brought further into the converging space 113 of the delivery rolls or roller pair 105 than the other apron, e.g. the lower apron 112.

Figure 2:
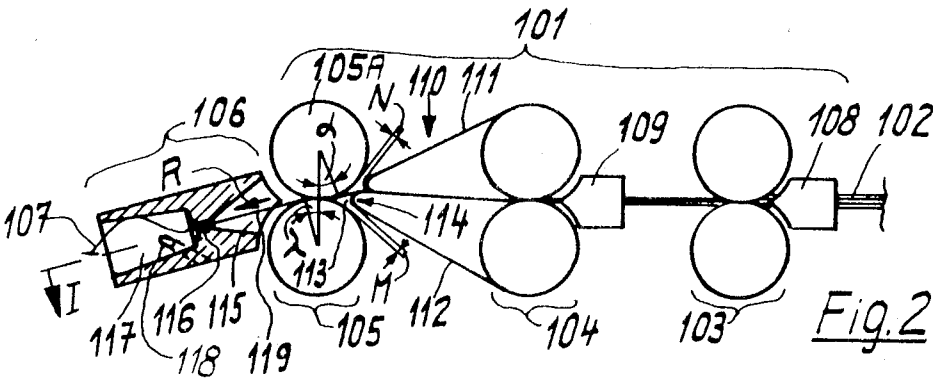
FIG. 2 shows a longitudinal section of the apparatus according to the invention represented schematically and partly in section.

By this measure or means, there arises at the reversing or deflection position 114 of the apron 112 a diversion or deflection of the fiber sliver out of the plane (not shown) containing the nip line or nip K and the nip line or nip (not shown) produced by the intermediate rollers 104. Shifting of this reversal or deflection into the converging space 113 also produces an additional fiber guidance at a surface portion of the upper roller 105A of the delivery roller pair 105 indicated by the angle $\alpha$ (FIG. 2).

As a further measure for maintenance of the width B1, the aprons 111 and 112 are led so close to the corresponding rolls of the delivery roller pair 105 that the spacings M and N, respectively, are close to zero, so that the air stream produced by the rotating delivery rolls of the delivery roller pair 105 is practically hindered from flowing into the converging space 113.

These additional measures supplement the first measure which substantially avoids spreading of the edge fibers which are indicated at F and FA in the prior art described with reference to FIG. 1.

The false twist unit 106 located downstream from the delivery roller pair 105 comprises substantially a suction passage or channel 115, a throttle position 116 known from the aforementioned Swiss Pat. No. 615,467, and a pneumatic false twist member or element 117 with at least one air infeed duct 119.

As can be seen from FIGS. 3 to 5*a* and as is known from the theory of false twist spinning (also called jet spinning), the yarn twist created in the false twist member 117 produces in practice a so-called false-twisted yarn core 119 with a twist inclination at the angle $\beta$ (FIG. 7), e.g. with an S-twist as shown in FIGS. 3 to 5*a*.

Through this twisting there arises a spinning triangle defined by the nip line or nip K with a width B2 (illustrated in FIGS. 3 and 6) given by the intensity of the twisting effect; width B2 should be substantially smaller than the above-mentioned fiber sliver width B1, that is for a given width B2, the width B1 is so chosen in dependence upon the average processed fiber length and spun yarn titer that an adequate number of edge fibers F is produced for wrapping of the yarn core 119.

It has been established that the front ends (as viewed in the direction of transport R—FIG. 2—of the yarn core 119) of the edge fibers F drawn in by the suction passage 115 (FIG. 2) are guided along a path corresponding substantially to a conical spiral towards the yarn core 119 rotating with a high speed (e.g. 200,000 rpm), and are generally caught or entrained by the rotating yarn core 119 before the narrowest position or throat of the suction passage 115. This path arises due to an air vortex produced by the rotating yarn core 119. Thereafter, and as has been illustrated in FIGS. 6 to 8, the following occurs:

After the front end of the edge fiber F has been caught or entrained by the rotating yarn core 119, provided that the rear end of the caught fiber is still guided in the nip line K, this edge fiber wraps around the yarn core 119 in the same twist direction. In other words, with S-twist of the yarn core 119 there is also an S-twist of the wrapping fiber, but with a substantially larger twist inclination with the angle $\gamma$. However, the angle increases towards the spinning triangle and can correspond to the angle $\beta$ shortly before the spinning triangle.

This increased inclination arises because the wrap of the edge fiber travels or migrates in a direction opposite to the forward movement of the yarn, that is towards the spinning triangle, with a speed greater than that of the forward movement of the yarn core 119. Provided that the rear fiber end is still caught by the nip line K, the increased inclination ensures that this end is twisted into the spinning triangle, so that the rear fiber end thereafter released by the nip line K remains held in the yarn core 119 of the finished yarn.

The inclination is greater by an amount corresponding to the speed of the aforementioned travel of the wrap. In order to ensure winding of the rear fiber end into the spinning triangle, the distance D between the narrowest position or throat of the suction passage 115 and the nip line K must be smaller than the length of the edge fibers F. Premature winding-in of the aforementioned front fiber end can shorten the wrapping length of the edge fiber in such manner that the wrapping strength produced by the adhering length of the wrapping fiber is inadequate to impart a sufficient breaking strength to the finished yarn.

Furthermore, it has been found that the spinning triangle continually and variably divides into smaller spinning triangles with the varying width b2 (FIG. 6*a*), so that the edge fibers F must appear not only in the edge regions of the width B1, but edge fibers F must arise over the whole width B1 distributed outside and between the individual small spinning triangles.

Figure 6:
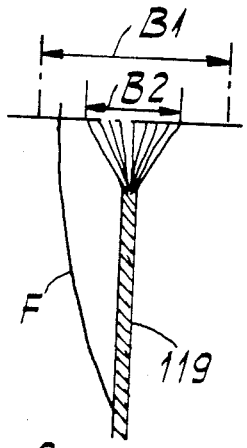
FIGS. 6, 6*a*, 7 and 8 show respective process steps represented part-schematically.
Figure 7:
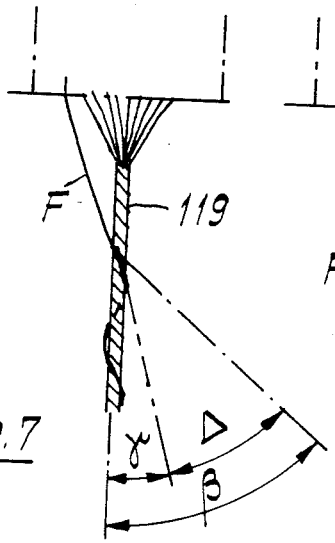
Figure 8:
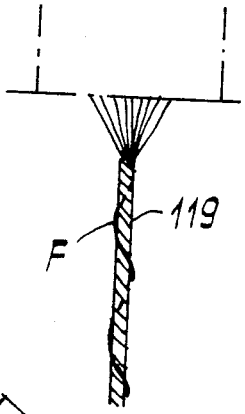

In comparison to the unitary spinning triangle explained by reference to FIGS. 6 to 8, the following relations can therefore be established:

unitary spinning triangle: $B1 = 10-30\% \geqq B2$ distributed spinning triangle: $B1 = 10-30\% \geqq \Sigma b2$.

This division into small spinning triangles arises through the tendency to hold the fiber density at the nip gap or line K at such a low value that the already mentioned free edge fibers F (not bound into the spinning triangle) can arise.

Figure 6A:
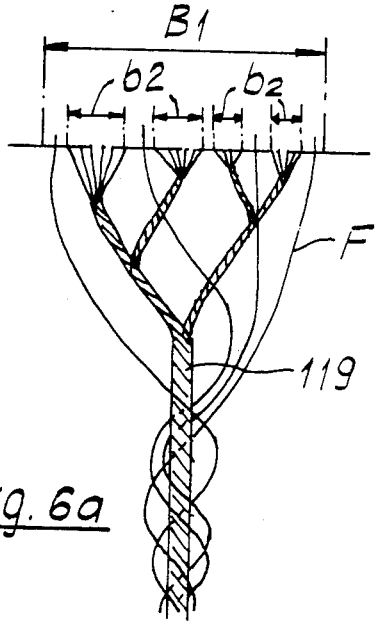

Through the division into small spinning triangles the advantage is produced that these edge fibers, as shown in FIG. 6*a*, can arise at positions distributed across the width B1, whereby a statistically regular occurrence of these edge fibers F arises.

It is furthermore possible that certain fibers of a fiber group forming a spinning triangle are nevertheless not contained in the spinning triangle as they leave the nip line K, namely when e.g. the adherence-force between these fibers and the rollers is greater than to the other fibers forming the spinning triangle. Like the so-called edge fibers F such fibers remain with their front ends free until, like the edge fibers F, they are caught or entrained by the rotating yarn core 119 and also form wrapping fibers.

Further, the optimum distance D should correspond to approximately 70% of the average or mean spun fiber length, but should not amount to less than 60% of this average or mean fiber length. The useful range for the distance D is 60% to 75% of the average or mean spun fiber length, preferably 68% to 72%.

Figure 9:
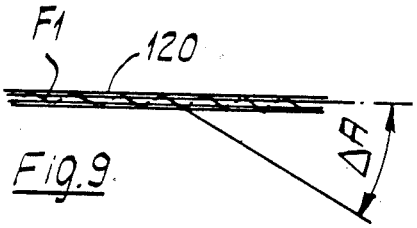
FIG. 9 shows the finished yarn represented part-schematically.

The finished yarn which is passed by a conventional withdrawal roller pair (not shown) provided after the false twist unit 106 to a suitable winding unit (not shown) consists of a substantially untwisted yarn core 120 (FIG. 9), which is held together by edge fibers F, now called wrapping fibers F1, wound around the yarn core 120.

The inclination ΔA (FIG. 9) of these wrapping fibers F1 corresponds substantially to the inclination difference Δ (FIG. 7) which arises from the difference between the inclination ($\beta$) of the yarn core 119 and the inclination ($\gamma$) of the edge fibers F. The wrapping direction of the wrapping fibers F1 is, however, opposite to that of the edge fibers F, that is if the edge fibers had an S-direction before the twist member then the wrapping fibers have a Z-direction. During the untwisting, the wound fibers have a disposition along a part of their length, and for a short time interval, lying parallel to the longitudinal axis of the yarn core until, due to the further untwisting, they increasingly take up the opposite wrapping direction.

The already-mentioned advantages of this method in comparison to the previously known method arise in that the wrapping takes place under a certain tension of the edge fibers due to catching of the front free fiber end and wrapping during a time in which the rear end of the edge fibers is still held by the nip line K, and furthermore the rear end is clearly and firmly wound into the yarn core and firmly held therein. Wrapping under tension produces a strong wrap in which the wrapping fibers stand under a certain pre-tension within their extensibility, so that upon untwisting of the yarn core not only the lengthening of the yarn core and the increase in the yarn core diameter but also the pre-tension assist in avoiding separation of the wrapping fibers from the core fibers in the intermediate position in which they lie partly for a short time parallel to the yarn axis.

This pre-tension can not arise either in those processes in which the fiber end belonging to the wrapping portion of the fiber projects freely during the wrapping stage, or in those processes in which the edge fibers lie parallel to the core fibers after the nip line and the wrapping occurs without binding in of the one or the other end of wrapping fibers.

A further contribution to the aforementioned advantages is to be seen in the fact that, through the selectable width B1 an adequate and assured quantity of edge fibers can be made available for wrapping, which number of fibers is substantially constant over time.

Figure 4:
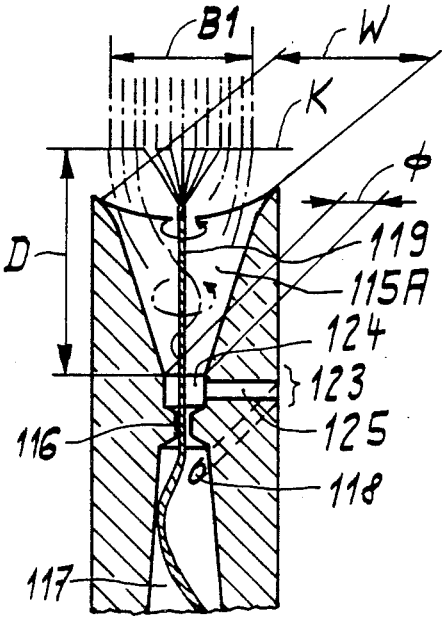
FIGS. 4, 5 and 5*a* show respective modifications of the part of FIG. 3, illustrated part-schematically and viewed in section in the same direction as depicted in FIG. 3.

FIG. 4 shows a modification of the false twist unit or device 106 in that a suction portion 123 is provided between the suction passage 115A and the throttle position or location 116. This suction portion 123 comprises a short intermediate chamber 124 connecting the suction passage 115A and the throttle position 116 and a suction bore 125 joining this intermediate chamber 124 with the environment of the false twist unit 106. Connected to this suction bore 125 is a suitable suction system (not shown) with which a quantity of air is drawn through the suction passage 115A additional to that drawn in by the false twist member 117.

The additional quantity of air serves to increase the air speed in the suction passage 115A so that the spiral path, in which the forward ends of the edge fibers F are transported, acquires a greater inclination. Through this increased inclination, or higher speed of suction, there is a tendency to ensure that the front fiber ends are better directed and are not caught or entrained too early but as close as possible to the narrowest position or throat of the suction passage 115A. Also, by means of the suction on bore 125, a possible loss of the edge fibers between the delivery roller pair 105 and the entry to the suction passage 115A is reduced.

Figure 5:
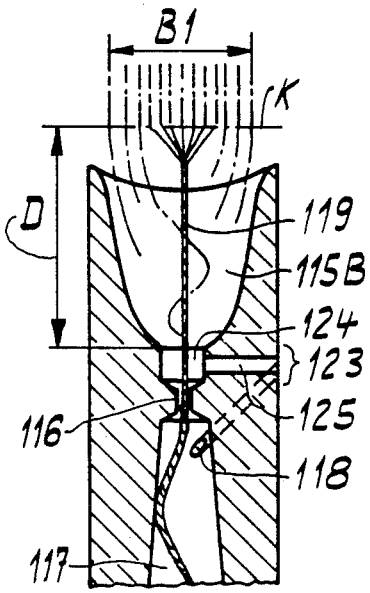

FIG. 5 shows, by means of the suction passage 115B, an additional variant of the suction passage for the last-mentioned purpose of fiber end guidance. This suction passage 115B has a substantially bell-shape such that the tendency towards premature catching of the aforementioned fiber ends by the rotating fiber core 119 can be still further counteracted.

Figure 5A:
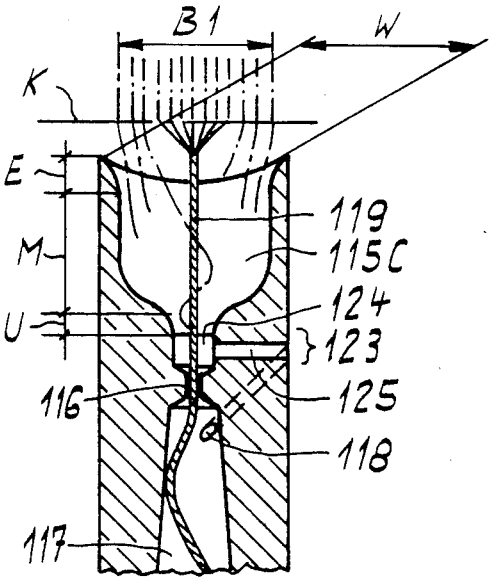

With the substantially tulip-shaped suction passage 115C shown in FIG. 5*a*, the front ends of the edge fibers F are fed into the upper region E of the suction passage 115C. In the intermediate region M, the edge fibers F are fed to the narrowest position or throat of the suction passage 115C while being guided in such a manner that they are, for as long as possible, not caught up by the rotating fiber core 119.

In the lower region U the edge fibers F are guided into a position in which the ends of the edge fibers F tend to take up a disposition parallel to the yarn core. In this last-mentioned disposition, the ends of the edge fibers F can be better caught or entrained by fiber ends (not shown) projecting from the rotating yarn core than in a disposition normal to the yarn core.

The design of the suction passage is, however, not limited to the forms shown in FIGS. 4 to 5*a*. Variations thereof can be optimized by tests. Likewise, the suction bore 125 can open tangentially into the intermediate chamber 124 so as to assist the above-mentioned rotation of the drawn-in air.

Spin tests have been carried out with the false twist spin unit and suction passages as set out in the following.

The stated values for the yarn properties are partly value ranges and since they were always measured with the same process or with the same device they mutually serve as comparison values.

In connection with these tests, the following data remains unchanged:

drawing frame sliver 3000 tex; 65% PES (fiber length 40 mm)/35% combed BW.
(PES=Polyester fiber/BW=cotton fiber)
Yarn 16 tex
Sliver width B1: 15 mm
Bore section or inner width W (only shown in FIGS. 4 and 5*a*): approx. 22 mm
Diameter $\phi$ (only shown in FIG. 4) of the narrowest position or throat of the suction passage 115A, 115B and 115C: 2.5 mm
Throttle position 116
(a) diameter: 0.8 mm
(b) length: 3 mm
Quantity of air drawn in:
(a) referring to suction passage 115: approx. 5 liters/-min.
(b) with reference to suction passages 115A, 115B, 115C: 23 to 25 liters/min.
Drafting mechanism arrangement according to FIG. 2.

Further, the stated $CV_{Uster}$ values are mass evenness values, that is the larger the value the worse the evenness.

Figure 3:
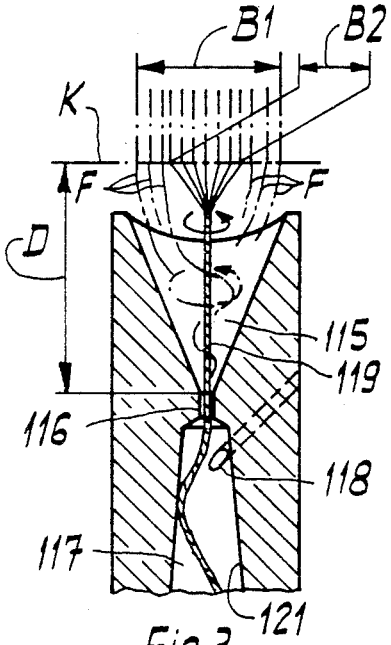
FIG. 3 shows the part which is represented in section in FIG. 2, illustrated to a larger scale and part-schematically, and as viewed in section in the direction of the section line I of FIG. 2.

| Suction Passage | $CV_{Uster}$ | Nop | Rkm |
|---|---|---|---|
| No. 10/FIG. 1 | 19.2 | 450 | 12.0 |
| No. 115/FIG. 3 | 16.8 | 220 | 13.8 |
| No. 115A/FIG. 4 | 15.6 | 95 | 17.1 |
| No. 115B/FIG. 5 | 16.1 | 135 | 16.7 |
| No. 115C/FIG. 5a | 15.9 | 125 | 17.2 |

Rkm in the above table is the breaking strength of the yarn as represented by the length of the yarn which would break under its own weight if freely suspended ('break km').

Spinning with a diameter $\phi$ (FIG. 4) of the narrowest position of more than 2.5 mm is possible but increasing diameter $\phi$ produces progressively worse properties. For example, the properties with a diameter $\phi$ of 4 mm are clearly worse.

On the other hand, it has been found that, with a diameter $\phi$ of 2.5 mm, fine and coarse yarns (e.g. 8 tex and 30 tex) can be spun with good yarn properties.

Values for diameter $\phi$ of less than 2.5 mm require greater suction pressures (higher energy) for the same air through-put (liters/min) and, in dependence upon the value, produce such a high air speed that free front fiber ends are occasionally caught, not by the rotating yarn core, but by the suction air so that the corresponding edge fibers F are fed as waste to the suction installation.

The relation between underpressure $\Delta p$ (at the narrowest position) and diameter $\phi$-value d (FIG. 4) can be expressed with the following formula for a given suction air stream:

$$\Delta p \cdot d4 = \text{constant}$$

Figure 10:
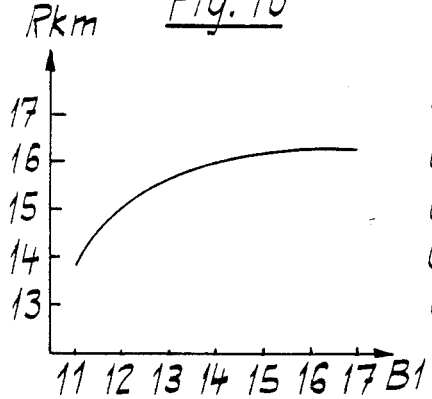
FIG. 10 shows a strength diagram of the finished yarn in dependence upon a characteristic parameter.
Figure 11:
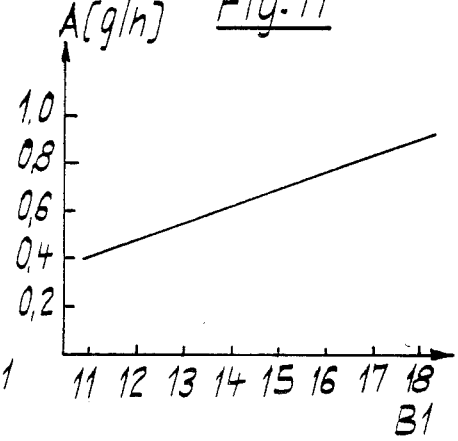
FIG. 11 shows a fiber loss diagram of the yarn in dependence upon a characteristic parameter.

The influence of the sliver width B1 on the yarn properties indicated with FIGS. 10 and 11 relates to the above-mentioned drawing frame sliver of 3000 tex and to the yarn of 16 tex spun with a false twist unit according to FIG. 4.

From the ordinates in FIG. 10, the breaking strength can be read in break km (Rkm) and the sliver width B1 can be read from the abscissa. This shows that the Rkm-value begins to stabilize with sliver widths B1 above 14 mm.

The fiber loss in grams/hour can be read from the ordinates of FIG. 11 and the sliver width B1 can be read from the abscissa.

From the comparison of these two diagrams it can be seen that for this yarn a sliver width B1 of 15 mm is optimal.

A broad fiber distribution between the aprons also brings the advantage of better fiber distribution in this drafting zone which carries out the main draft. This better fiber distribution results in a more even draft in this zone together with a longer service life for the aprons.

Other yarn counts and other fiber lengths produce different dimensions of the spinning triangle and correspondingly require different sliver widths B1. The optimal sliver width B1 must be established from case to case. For example, with the false twist spinning unit in accordance with FIG. 4 it could be established that an optimal width B1 for a yarn of 8 tex lies between 10 and 12 mm and for a yarn of 30 tex lies between 15 and 19 mm.

Figure 12:
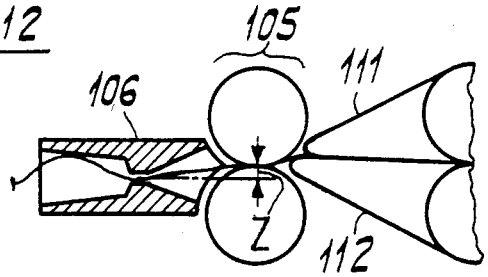
FIG. 12 shows a modification of the arrangement of FIG. 2.
Figures 13A, 13B, 13C, 13D:
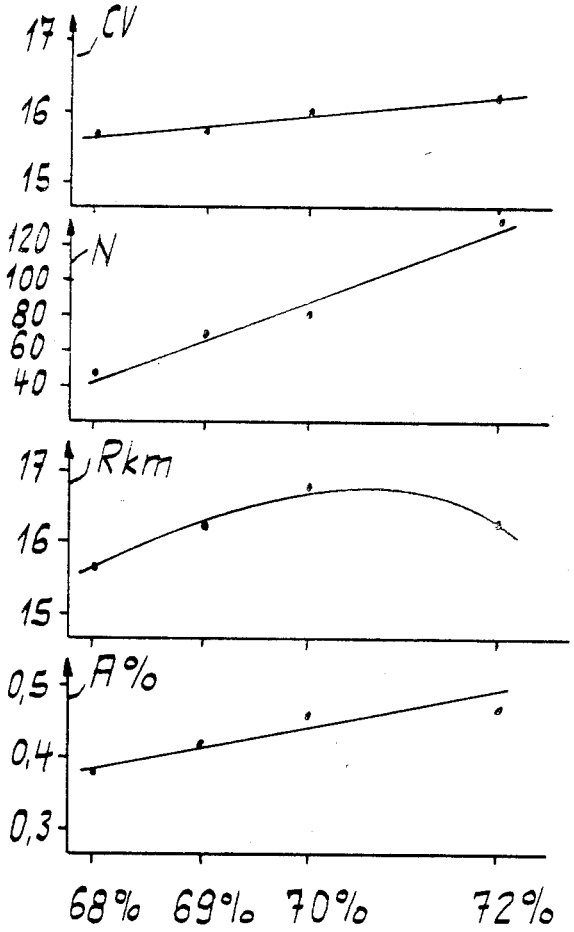
FIGS. 13*a* to 13*d* show various yarn property diagrams.

Furthermore, it has been found that a wrap angle, indicated with the angle $\lambda$ (FIG. 2) of the fiber sliver on one of the two delivery rolls, aids separation of the edge fibers from the spinning triangle. This wrap can be achieved in that either, as shown in FIG. 2, the false twist spinning unit 106 diverges by the angle $\lambda$ from an imaginary plane passing tangentially through the nip line K, or that, as shown in FIG. 12, the false twist spinning unit 106 is arranged parallel to but displaced from the said plane. The displacement (FIG. 12) is measured in mm.

In the last-mentioned arrangement, spinning tests were carried out in order to establish the influence of a departure from the optimal distance D. The tests were carried out with the use of a false twist spinning unit according to FIG. 4 located parallel to the above-mentioned plane and displaced therefrom by 5.5 mm, and with the mentioned unchanged data of the previously described test. The results of these tests are represented graphically in FIGS. 13*a–d*. The abscissa of FIG. 13*d* applies also to FIGS. 13*a–c* and shows values for the distance D in percent above and below the optimal distance of 70% of the average fiber length. The ordinates of FIGS. 13*a–d* show in sequence the CV-Uster-values, the number of nops per 1000 m with a setting stage 3, the breaking strength Rkm (CN/Tex) and the waste in percent. These values were obtained by internationally standardized measurement methods.

The illustrations show that with a decreasing distance the CV-Uster-values, the number of nops and the waste reduces as a substantially linear function over the illustrated range, while the breaking strength Rkm is reduced before and after the optimal distance D.

Finally, the false twist member does not have to be pneumatic, as shown in FIGS. 2 to 5*a*, but it is quite possible that a purely mechanical false twist member (not shown) can be used in conjunction with the suction passage 115A, 115B or 115C. The essential inventive concept of the relation of the width B1 to the length D can also be obtained with the use of a purely mechanical false twist member.

The invention disclosed herein and as defined in the claims is therefore not limited to the use of a pneumatic false twist member.

While there are shown and described present preferred embodiments of the invention, it is to be distinctly understood that the invention is not limited thereto, but may be otherwise variously embodied and practiced within the scope of the following claims.

Accordingly, what we claim is:

1. In a method of false twist spinning comprising the steps of:

drafting a fiber sliver to a desired yarn count in a drafting mechanism having a delivery roller pair and delivering the drafted fiber sliver from the delivery roller pair of the drafting mechanism;

sucking the delivered drafted fiber sliver in a substantially spiral fashion into a converging passage and thereafter taking up such sucked-up drafted fiber sliver by a false twist member;

twisting a part of the drafted fiber sliver to form a false-twisted rotating yarn core with the formation of a spinning triangle by means of the false twist member; the improvement which comprises the steps of;

delivering the drafted fiber sliver from the delivery rollers with a width such that only a part of the width of the drafted fiber sliver is entrained by the spinning triangle and twisted to the false-twisted rotating yarn core; and sucking up and guiding by means of a suction air stream edge fibers which are not entrained by the spinning triangle in such a manner that, as viewed in the direction of travel of the yarn core, the front end of a fiber of the edge fibers and which fiber has a length corresponding to the average length of the processed fibers is entrained by the rotating yarn core while assuring that this fiber only leaves a nip line of the delivery roller pair after it has been twisted about the yarn core and after it has been entrained in the spinning triangle, whereby the rear end of the fiber is bound into the yarn core.

2. The method as defined in claim 1, further including the step of:

controlling the width of the drafted fiber sliver so as to be 10% to 30% greater than the width of the spinning triangle.

3. The method as defined in claim 2, wherein:

the step of controlling the width of the drafted fiber sliver is accomplished by broadly guiding the fiber sliver before an infeed roller pair of the drafting mechanism and before the delivery roller pair of the drafting mechanism in order to obtain said width of the drafted fiber sliver.

4. The method as defined in claim 3, further including the step of:

additionally broadly guiding the fiber sliver before an intermediate roller pair of the drafting mechanism.

5. The method as defined in claim 2, further including the steps of:

directly feeding the fiber sliver into a converging space of the delivery roller pair.

6. The method as defined in claim 2, further including the steps of:

substantially preventing the penetration of circumferential air of rotating delivery rollers of the delivery roller pair into a converging space of the delivery roller pair.

7. The method as defined in claim 1, further including the steps of:

entraining the front end of an edge fiber by the rotating yarn core when the edge fiber has left the nip line of the delivery roller pair through a length corresponding to 60% to 75% of the average fiber length of the processed fibers.

8. The method as defined in claim 7, wherein:

said length corresponds to 68% to 72% of the average fiber length.

9. The method as defined in claim 1, further including the steps of:

using as the false twist member a false twist jet; and producing the suction air stream by means of said false twist jet.

10. The method as defined in claim 9, further including the step of:

supplementing the suction air stream produced by the false twist jet by means of a suction part provided between the false twist jet and said converging passage into which there is sucked said delivered drafted fiber sliver.

11. The method as defined in claim 10, further including the steps of:

imparting a rotation to the suction air stream such that the free ends of the sucked-up edge fibers are set into rotation about the yarn core along a path to the region in which they are entrained by the rotating yarn core and due to the centrifugal force arising therefrom are subjected to a force directed towards a wall of the converging passage so that these fiber ends reach said region along a conically-spiral-shaped path around the yarn core.

12. The method as defined in claim 11, further including the steps of:

producing said rotation of the suction air stream by the rotating yarn core.

13. The method as defined in claim 12, further including the steps of:

additionally producing the rotation of the suction air stream by means of a suction part.

14. In an apparatus for false twist spinning with a drafting mechanism containing a delivery roller pair and delivering a drafted fiber sliver to a suction passage through which flows a suction air stream and with a false twist member arranged after the suction passage, the suction passage converging towards its narrowest position in a direction towards the false twist member, the improvement which comprises:

means provided for the drafting mechanism, before said delivery roller pair delivering the fiber sliver to the suction passage, for guiding the fiber sliver in the drafting mechanism in such a manner that the drafted fiber sliver delivered by the delivery roller pair has a width which is greater than the width of a spinning triangle of a yarn core rotated by means of the false twist member;

the spacing between a nip line formed by the delivery roller pair and the narrowest position of the suction passage is not larger than 75% of the average fiber length of the fibers contained in the fiber sliver; and the suction passage has a converging form such that free front fiber ends of the drafted fiber sliver, which are delivered by the delivery roller pair and which are guided in the suction air stream of the suction passage and are not bound into the rotating yarn core produced by the false twist member, are guided towards the rotating yarn core shortly before the narrowest position of the suction passage such that they are thereby entrained by the rotating yarn core in the region of the spacing between said nip line and said narrowest position of the suction passage.

15. The apparatus as defined in claim 14, wherein:

said drafting mechanism includes an infeed roller pair; and said means provided for the drafting mechanism comprises a respective fiber sliver guiding element arranged before said infeed roller pair of the drafting mechanism and before said delivery roller pair of the drafting mechanism.

16. The apparatus as defined in claim 15, wherein:

said fiber sliver guiding element arranged before the infeed roller pair comprises a condenser.

17. The apparatus as defined in claim 15, wherein:

said fiber sliver guiding element arranged before the delivery roller pair comprises an apron pair.

18. The apparatus as defined in claim 17, wherein:

said delivery roller pair includes two delivery rollers defining a converging space therebetween;

said apron pair includes two aprons and projects into said converging space of said delivery rollers;

one of the two aprons of said apron pair projecting further into the converging space than the other apron; and both aprons being guided close to a related delivery roller of the two delivery rollers such that the respective spacing between each apron and said related delivery roller amounts to approximately zero.

19. The apparatus as defined in claim 15, wherein:

said delivery roller pair defines a converging space; and said fiber sliver guiding element arranged before the delivery roller pair projects into said converging space of the delivery roller pair.

20. The apparatus as defined in claim 15, wherein:

said drafting mechanism comprises an intermediate roller pair; and said means provided for said drafting mechanism includes a fiber sliver guiding element provided before said intermediate roller pair.

21. The apparatus as defined in claim 20, wherein:

said fiber sliver guiding element provided before said intermediate roller pair comprises a condenser.

22. The apparatus as defined in claim 14, wherein:

the spacing between the nip line and the narrowest position of the suction passage amounts to 60% to 75% of said average fiber length.

23. The apparatus as defined in claim 22, wherein:

said spacing amounts to 68% to 72% of said average fiber length.

24. The apparatus as defined in claim 14, wherein:

said false twist member is structured such that the suction air stream is produced by the false twist member.

25. The apparatus as defined in claim 24, wherein:

the narrowest position of the suction passage defines a throttle position provided between the suction passage and the false twist member.

26. The apparatus as defined in claim 25, further including:

a suction part provided between the suction passage and the throttle position in order to reinforce the suction air stream.

27. The apparatus as defined in claim 26, wherein:

the narrowest position of the suction passage defines the diameter of the suction part which communicates therewith.

28. The apparatus as defined in claim 26, wherein:

said suction part comprises an intermediate chamber adjoining the suction passage; and a suction bore provided for said intermediate chamber.

29. The apparatus as defined in claim 28, wherein:

said suction bore opens substantially tangentially into the intermediate chamber.

30. The apparatus as defined in claim 14, wherein:

said suction passage defines a substantially uniformly converging suction passage.

31. The apparatus as defined in claim 14, wherein:

said suction passage defines a passage converging in a substantially bell-shaped manner.

32. The apparatus as defined in claim 14, wherein:

said suction passage defines a passage converging in a substantially tulip-shaped manner.

* * * * *